US007271563B2

(12) United States Patent
Yoo et al.

(10) Patent No.: US 7,271,563 B2
(45) Date of Patent: Sep. 18, 2007

(54) APPARATUS FOR CONTROLLING OPERATION OF RECIPROCATING COMPRESSOR, AND METHOD THEREFOR

(75) Inventors: Jae-Yoo Yoo, Gyeonggi-do (KR); Chel-Woong Lee, Seoul (KR); Hyung-Joo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 561 days.

(21) Appl. No.: 10/930,842

(22) Filed: Sep. 1, 2004

(65) Prior Publication Data

US 2005/0141998 A1 Jun. 30, 2005

(30) Foreign Application Priority Data

Nov. 26, 2003 (KR) ..... 10-2003-0084642

(51) Int. Cl.
*H02P 1/00* (2006.01)
*G05D 23/275* (2006.01)
*F04B 49/06* (2006.01)

(52) U.S. Cl. ..... 318/632; 318/119; 318/135; 417/44.1; 417/44.11

(58) Field of Classification Search ..... 318/119, 318/120, 135, 632, 556; 417/44.8, 44.11, 417/44.1, 45; 324/76.52; 62/6, 228.1
See application file for complete search history.

(56) References Cited

U.S. PATENT DOCUMENTS 6,520,746 B2 * 2/2003 Yoo et al.
6,541,953 B2 * 4/2003 Yoo et al. ..... 324/76.52
6,616,414 B2 * 9/2003 Yoo et al. ..... 417/44.1
6,685,438 B2 * 2/2004 Yoo et al. ..... 417/44.11
6,815,922 B2 * 11/2004 Yoo et al. ..... 318/632
6,851,934 B2 * 2/2005 Yoo et al. ..... 417/44.11
6,930,462 B2 * 8/2005 Yoo et al. ..... 318/632

(Continued)

FOREIGN PATENT DOCUMENTS

DE 101 44 622 A1 6/2002

(Continued)

*Primary Examiner*—Paul Ip
(74) *Attorney, Agent, or Firm*—Birch, Stewart, Kolasch & Birch, LLP

(57) ABSTRACT

The present invention discloses an apparatus for controlling an operation of a reciprocating compressor and a method therefor which can reduce errors in an operation of a stroke estimated value of the reciprocating compressor, by previously preventing over-saturation of a magnetic flux density generated in a coil of a motor. The apparatus for controlling the operation of the reciprocating compressor includes a magnetic flux saturation constant operation unit for operating a magnetic flux saturation constant of a motor of the reciprocating compressor on the basis of a stroke estimated value of the reciprocating compressor, a stroke reference value generation unit for generating an increased or decreased stroke reference value by increasing or decreasing a predetermined stroke reference value on the basis of the magnetic flux saturation constant, and a control unit for controlling a voltage applied to the motor of the reciprocating compressor on the basis of the generated stroke reference value.

20 Claims, 4 Drawing Sheets

U.S. PATENT DOCUMENTS

2002/0051710 A1* 5/2002 Yoo et al. ..... 417/44.11
2002/0090304 A1* 7/2002 Yoo et al. ..... 417/44.1
2002/0093327 A1* 7/2002 Yoo et al. ..... 324/76.52
2003/0026702 A1* 2/2003 Yoo et al. ..... 417/44.11
2004/0066163 A1* 4/2004 Yoo et al. ..... 318/632
2004/0067140 A1* 4/2004 Yoo et al. ..... 417/44.1
2004/0071556 A1* 4/2004 Sung et al. ..... 417/44.1
2005/0111987 A1* 5/2005 Yoo et al. ..... 417/44.11
2005/0137722 A1* 6/2005 Yoo et al. ..... 700/32
2005/0158178 A1* 7/2005 Yoo et al. ..... 417/45
2006/0056979 A1* 3/2006 Yoo et al. ..... 417/44.11
2006/0228224 A1* 10/2006 Hong et al. ..... 417/44.1
2006/0251523 A1* 11/2006 Lee et al. ..... 417/44.1
2006/0251524 A1* 11/2006 Yoo et al. ..... 417/53

FOREIGN PATENT DOCUMENTS

EP 1720245 A2 * 11/2006
JP 2002250602 A * 9/2002
JP 2002-364551 A 12/2002
JP 2005155616 A * 6/2005
JP 2006291956 A * 10/2006
KR 1020030013649 A 2/2003
KR 1020030063722 A 7/2003

* cited by examiner stroke(ptp)=max(x(t)−min(x(t))

stroke(sum)=S1+S2

APPARATUS FOR CONTROLLING OPERATION OF RECIPROCATING COMPRESSOR, AND METHOD THEREFOR

This Nonprovisional application claims priority under 35 U.S.C. § 119(a) on Patent Application No(s). 10-2003-0084642 filed in Korea, Republic of on Nov. 26, 2003, the entire contents of which are hereby incorporated by reference.

BACKGROUND OF THE INVENTION

1. Field of the Invention

The present invention relates to a reciprocating compressor, and more particularly to, an apparatus for controlling an operation of a reciprocating compressor, and a method therefor.

2. Description of the Background Art

In general, a reciprocating compressor sucks and compresses a refrigerant gas by linearly reciprocating a piston in a cylinder, and discharges the compressed refrigerant gas. The reciprocating compressor is classified into a recipro method compressor and a linear method compressor according to a method for driving a piston.

In the compressor using the recipro method, a rotary force of a rotary motor is transformed into a reciprocating motion by coupling a crank shaft to the rotary motor and coupling a piston to the crank shaft, but in the compressor using the linear method, a piston coupled to a mover of a linear motor performs a linear motion.

The linear method reciprocating compressor does not have a crank shaft for transforming a rotary motion into a linear motion, does not generate a friction loss by the crank shaft, and thus shows higher compression efficiency than a general compressor.

When the reciprocating compressor is used for a refrigerator or an air conditioner, a compression ratio of the reciprocating compressor can be changed by varying a voltage applied to a motor of the reciprocating compressor. It is thus possible to control a cooling capacity of the refrigerator or the air conditioner.

A conventional apparatus for controlling an operation of a reciprocating compressor and a method therefor will now be explained with reference to FIGS. 1 and 2.

FIG. 1 is a block diagram illustrating the conventional apparatus for controlling the operation of the reciprocating compressor.

Referring to FIG. 1, the conventional apparatus for controlling the operation of the reciprocating compressor includes: a current detection unit 4 for detecting a current applied to a motor of the reciprocating compressor; a voltage detection unit 3 for detecting a voltage applied to the motor of the reciprocating compressor; a stroke estimator 5 for operating a stroke of the reciprocating compressor on the basis of the detected current value, the detected voltage value and parameters of the motor (for example, resistance of the motor, inductance of the motor and motor constant); a comparator 1 for comparing the operated stroke estimated value with a predetermined stroke reference value, and outputting a difference signal according to the comparison result; and a controller 2 for controlling the stroke of the reciprocating compressor by varying the voltage applied to the motor of the reciprocating compressor.

The operation of the conventional apparatus for controlling the operation of the reciprocating compressor will now be explained with reference to FIG. 2.

FIG. 2 is a flowchart showing sequential steps of the conventional method for controlling the operation of the reciprocating compressor.

As shown in FIG. 2, the conventional method for controlling the operation of the reciprocating compressor includes the steps of: detecting the voltage and current applied to the motor of the reciprocating compressor (S20); operating the stroke estimated value of the reciprocating compressor on the basis of the detected voltage value, the detected current value and the parameters of the motor (S21); comparing the operated stroke estimated value with the predetermined stroke reference value (S22); decreasing the voltage applied to the motor when the operated stroke estimated value is larger than the predetermined stroke reference value (S23); and increasing the voltage applied to the motor when the operated stroke estimated value is smaller than the predetermined stroke reference value (S24).

The conventional method for controlling the operation of the reciprocating compressor will now be described in more detail.

The voltage detection unit 3 detects the voltage applied to the motor of the reciprocating compressor and outputs the detected voltage value to the stroke estimator 5, and the current detection unit 4 detects the current applied to the motor of the reciprocating compressor and outputs the detected current value to the stroke estimator 5 (S20).

The stroke estimator 5 operates the stroke estimated value of the reciprocating compressor by applying the detected current value, the detected voltage value and the parameters of the motor to following formula 1, and outputs the operated stroke estimated value to the comparator 1 (S21).

$$x = \frac{1}{a}\int (V_M - Ri - L\dot{i})dt \qquad \text{⟨Formula 1⟩}$$

Here, R represents the resistance of the motor, L represents the inductance of the motor, $\alpha$ represents the motor constant, $V_M$ represents the voltage value applied to the motor of the reciprocating compressor, and i represents the current value applied to the motor of the reciprocating compressor.

The comparator 1 compares the operated stroke estimated value with the predetermined stroke reference value, generates the difference signal according to the comparison result, and outputs the difference signal to the controller 2 (S22).

The controller 2 controls the stroke of the reciprocating compressor by varying the voltage applied to the motor of the reciprocating compressor on the basis of the difference signal. That is, when the operated stroke estimated value is larger than the predetermined stroke reference value, the controller 2 decreases the voltage applied to the motor of the reciprocating compressor (S23), and when the operated stroke estimated value is smaller than the predetermined stroke reference value, the controller 2 increases the voltage applied to the motor of the reciprocating compressor (S24).

Accordingly, the conventional method for controlling the operation of the reciprocating compressor controls the voltage applied to the motor of the reciprocating compressor by detecting the voltage and current applied to the motor of the reciprocating compressor, and operating the stroke estimated value of the reciprocating compressor in a sensorless method on the basis of the detected voltage and current.

However, in the conventional apparatus for controlling the operation of the reciprocating compressor and the method therefor, when the load on the motor of the reciprocating compressor is overloaded, a magnetic flux density generated in a coil of the motor is saturated, and thus the motor constant has non-linear characteristics. As a result, errors are generated due to the motor constant in the operation of the stroke estimated value of the reciprocating compressor, and thus the stroke of the reciprocating compressor is not normally controlled.

SUMMARY OF THE INVENTION

Therefore, an object of the present invention is to provide an apparatus for controlling an operation of a reciprocating compressor and a method therefor which can reduce errors in an operation of a stroke estimated value of the reciprocating compressor, by previously preventing over-saturation of a magnetic flux density generated in a coil of a motor, by operating a magnetic flux saturation constant of the motor on the basis of the stroke estimated value of the reciprocating compressor and increasing or decreasing a predetermined stroke reference value on the basis of the operated magnetic flux saturation constant.

To achieve these and other advantages and in accordance with the purpose of the present invention, as embodied and broadly described herein, there is provided an apparatus for controlling an operation of a reciprocating compressor, including: a magnetic flux saturation constant operation unit for operating a magnetic flux saturation constant of a motor of the reciprocating compressor on the basis of a stroke estimated value of the reciprocating compressor; a stroke reference value generation unit for generating an increased or decreased stroke reference value by increasing or decreasing a predetermined stroke reference value on the basis of the operated magnetic flux saturation constant; and a control unit for controlling a voltage applied to the motor of the reciprocating compressor on the basis of the generated stroke reference value and the stroke estimated value.

According to another aspect of the present invention, a method for controlling an operation of a reciprocating compressor includes the steps of: operating a magnetic flux saturation constant of a motor of the reciprocating compressor; generating an increased or decreased stroke reference value by increasing or decreasing a predetermined stroke reference value on the basis of the operated magnetic flux saturation constant; and controlling a voltage applied to the motor of the reciprocating compressor on the basis of the generated stroke reference value and the operated stroke estimated value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus for controlling an operation of a reciprocating compressor and a method therefor which can reduce errors in an operation of a stroke estimated value of the reciprocating compressor, by previously preventing over-saturation of a magnetic flux density generated in a coil of a motor of the reciprocating compressor, by operating a magnetic flux saturation constant of the motor on the basis of the stroke estimated value of the reciprocating compressor and increasing or decreasing a predetermined stroke reference value on the basis of the operated magnetic flux saturation constant will now be described in detail with reference to FIGS. 3 to 5B.

Figure 1:
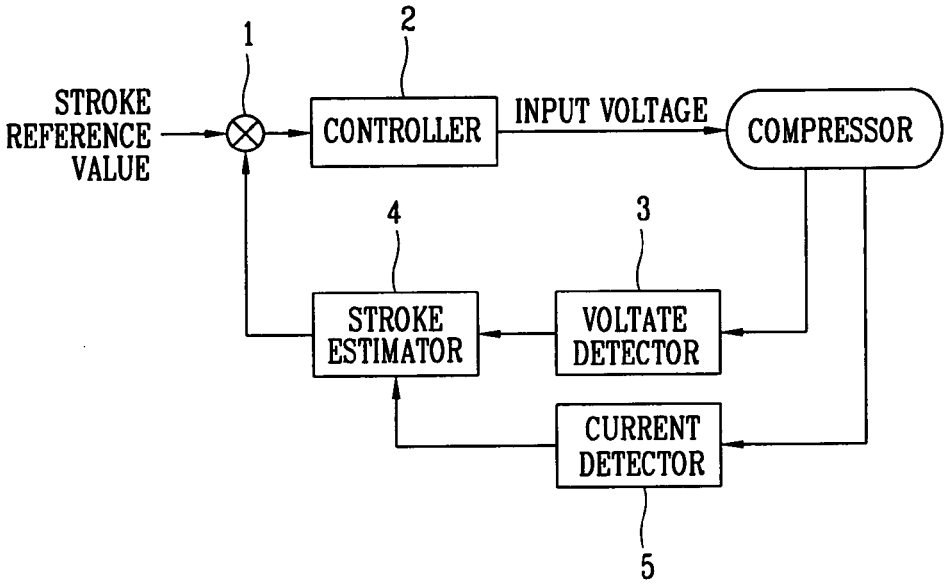
FIG. 1 CONVENTIONAL ART
FIG. 1 is a block diagram illustrating a conventional apparatus for controlling an operation of a reciprocating compressor.
Figure 2:
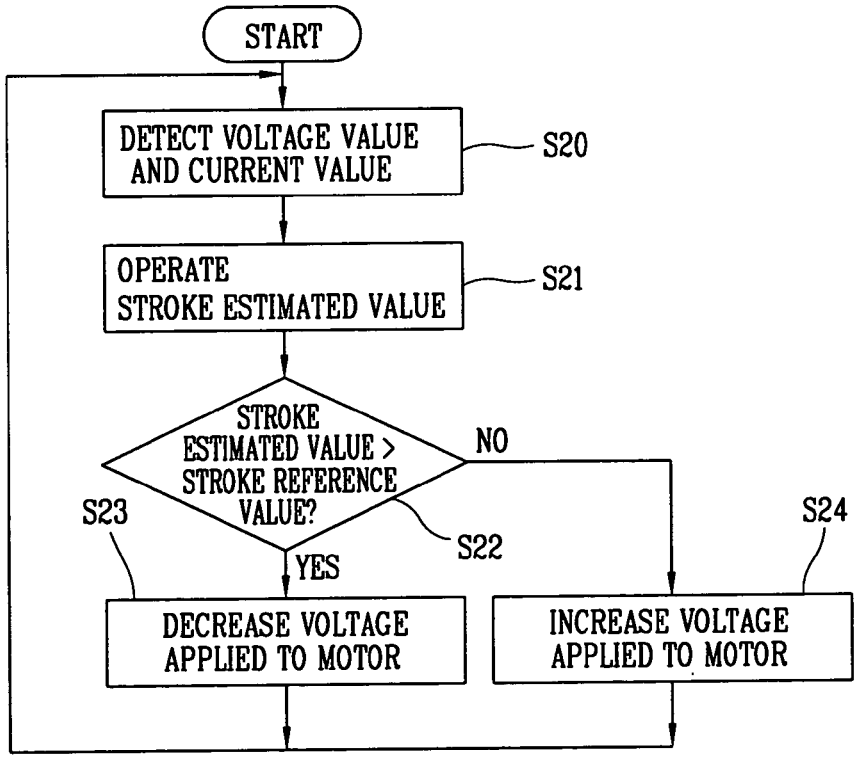
FIG. 2 CONVENTIONAL ART
FIG. 2 is a flowchart showing sequential steps of a conventional method for controlling an operation of a reciprocating compressor.
Figure 3:
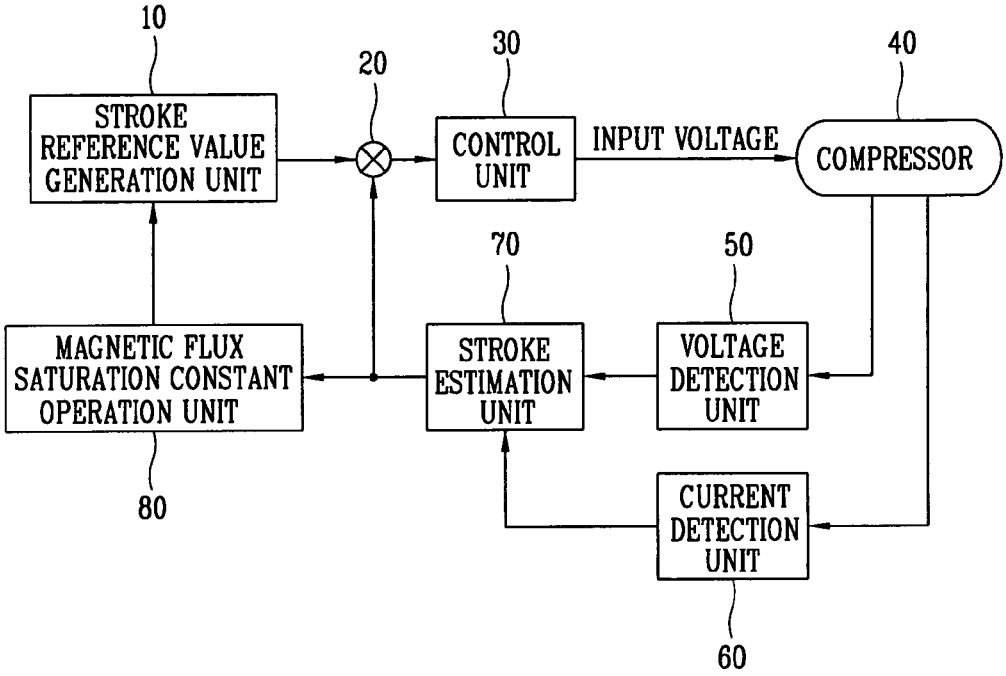
FIG. 3 is a block diagram illustrating an apparatus for controlling an operation of a reciprocating compressor in accordance with the present invention.

FIG. 3 is a block diagram illustrating the apparatus for controlling the operation of the reciprocating compressor in accordance with the present invention.

As illustrated in FIG. 3, the apparatus for controlling the operation of the reciprocating compressor includes: a current detection unit 50 for detecting a current applied to a motor of the reciprocating compressor; a voltage detection unit 50 for detecting a voltage applied to the motor of the reciprocating compressor; a stroke estimation unit 70 for operating a stroke estimated value of the reciprocating compressor on the basis of the detected current value, the detected voltage value and parameters of the motor; a magnetic flux saturation constant operation unit 80 for operating a magnetic flux saturation constant of the motor of the reciprocating compressor on the basis of the operated stroke estimated value; a stroke reference value generation unit 10 for comparing the operated magnetic flux saturation constant with a preset reference magnetic flux saturation constant, and increasing or decreasing a predetermined stroke reference value according to the comparison result; a comparison unit 20 for comparing the stroke reference value generated in the stroke reference value generation unit 10 with the operated stroke estimated value, and outputting a difference signal according to the comparison result; and a control unit 30 for controlling a stroke of the motor by varying the voltage applied to the motor of the reciprocating compressor on the basis of the difference signal from the comparison unit 20.

The operation of the apparatus for controlling the operation of the reciprocating compressor will now be explained in detail with reference to FIG. 4.

Figure 4:
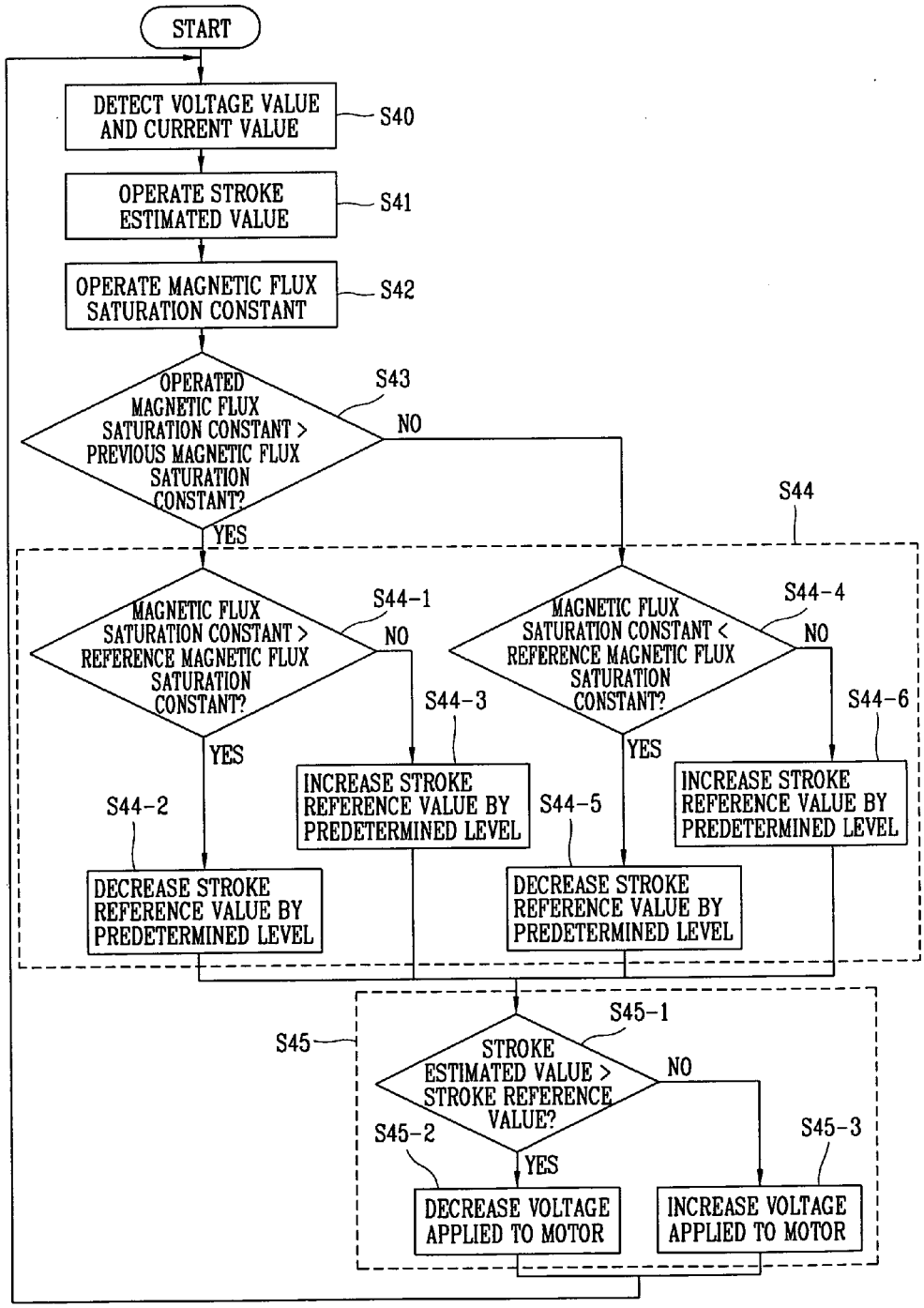
FIG. 4 is a flowchart showing sequential steps of a method for controlling an operation of a reciprocating compressor in accordance with the present invention.

FIG. 4 is a flowchart showing sequential steps of the method for controlling the operation of the reciprocating compressor in accordance with the present invention.

As shown in FIG. 4, the method for controlling the operation of the reciprocating compressor includes the steps of: detecting the current applied to the motor of the reciprocating compressor; detecting the voltage applied to the motor of the reciprocating compressor; operating the stroke estimated value of the reciprocating compressor on the basis of the detected current value, the detected voltage value and the parameters of the motor; operating the magnetic flux saturation constant of the motor on the basis of the operated stroke estimated value; comparing the operated magnetic flux saturation constant with the preset reference magnetic flux saturation constant, increasing or decreasing the predetermined stroke reference value according to the comparison result, and generating the increased or decreased stroke reference value; comparing the generated stroke reference value with the operated stroke estimated value, and outputting the difference signal according to the comparison result; and controlling the stroke of the motor by varying the voltage applied to the motor of the reciprocating compressor on the basis of the difference signal.

The method for controlling the operation of the reciprocating compressor will now be explained in detail.

The current detection unit 60 detects the current applied to the motor of the reciprocating compressor in every period corresponding to one compression stroke of the reciprocating compressor, and outputs the detected current value to the stroke estimation unit 70. The voltage detection unit 50 detects the voltage applied to the motor of the reciprocating compressor in every period corresponding to one compression stroke of the reciprocating compressor, and outputs the detected voltage value to the stroke estimation unit 70 (S40).

The stroke estimation unit 70 operates the stroke estimated value of the reciprocating compressor on the basis of the detected current value, the detected voltage value and the parameters of the motor of the reciprocating compressor, and outputs the operated stroke estimated value of the reciprocating compressor to the magnetic flux saturation constant operation unit 80 (S41).

The magnetic flux saturation constant operation unit 80 operates the magnetic flux saturation constant, and outputs the magnetic flux saturation constant to the stroke reference value generation unit 10 (S42). Here, the magnetic flux saturation constant is represented by following formula 2:

$$\text{Magnetic flux saturation constant} = \text{Stroke}(ptp)/\text{Stroke(sum)} * 100[\%] = \text{Stroke}(ptp)/\text{Stroke(rms)} * 100[\%] \quad \langle\text{Formula 2}\rangle$$

That is, the magnetic flux saturation constant is obtained by dividing a stroke absolute size Stroke(ptp) in one period corresponding to one stroke of the reciprocating compressor by a stroke summation value Stroke(sum) in the period, or by dividing the stroke absolute size Stroke(ptp) in the period by a stroke root means square value Stroke(rms) in the period. The stroke absolute size Stroke(ptp) and the stroke summation value Stroke(sum) will now be explained with reference to FIGS. 5A and 5B.

Figure 5A:
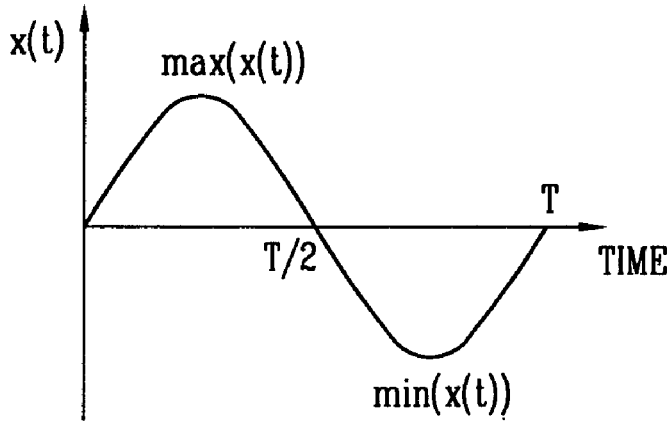
FIG. 5A is a waveform diagram defining a stroke of the reciprocating compressor in accordance with the present invention.
Figure 5B:
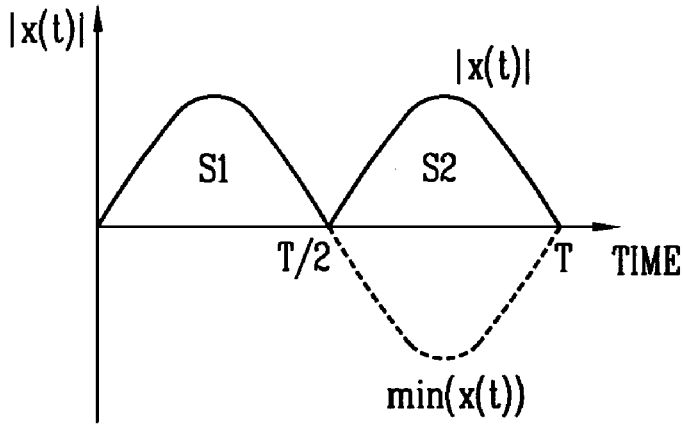
FIG. 5B is a waveform diagram defining a size of the stroke of the reciprocating compressor in accordance with the present invention.

FIG. 5A is a waveform diagram defining the stroke of the reciprocating compressor by a time function in accordance with the present invention, and FIG. 5B is a waveform diagram defining a size of the stroke of the reciprocating compressor by the time function in accordance with the present invention.

Referring to FIG. 5A, the stroke absolute size Stroke(ptp) is obtained by subtracting a stroke minimum value min(x(t)) from a stroke maximum value max(x(t)), that is, stroke(ptp) =max(x(t))−min(x(t)), 0<t<T(one stroke reciprocating period). Here, x(t) represents the time function of the stroke of the reciprocating compressor.

As shown in FIG. 5B, the stroke summation value Stroke (sum) is obtained by summating the stroke absolute size in one period, that is, stroke(sum)=summation(absolute(x(t))) =S1+S2, 0<t<T(one stroke reciprocating period). Here, S1 and S2 represent values obtained by summating the stroke absolute size of the reciprocating compressor in half a period.

The stroke reference value generation unit 10 compares the operated magnetic flux saturation constant with the magnetic flux saturation constant in the previous period (S43), compares the operated magnetic flux saturation constant with the preset reference magnetic flux saturation constant (S44-1 and S44-4), and increases or decreases the predetermined stroke reference value according to the comparison results (S44). That is, when the operated magnetic flux saturation constant is larger than the magnetic flux saturation constant in the previous period, and when the operated magnetic flux saturation constant is larger than the preset reference magnetic flux saturation constant, the stroke reference value generation unit 10 decreases the stroke reference value by a predetermined level (S44-2), and when the operated magnetic flux saturation constant is larger than the magnetic flux saturation constant in the previous period, and when the operated magnetic flux saturation constant is smaller than the preset reference magnetic flux saturation constant, the stroke reference value generation unit 10 increases the stroke reference value by a predetermined level (S44-3).

According to the experiment, the maximum value of the magnetic flux saturation constant for operating the motor of the reciprocating compressor when the magnetic flux density generated in the coil of the motor is saturated is decided as the reference magnetic flux saturation constant.

In addition, when the operated magnetic flux saturation constant is smaller than the magnetic flux saturation constant in the previous period, and when the operated magnetic flux saturation constant is larger than the preset reference magnetic flux saturation constant, the stroke reference value generation unit 10 increases the stroke reference value by a predetermined level (S44-5), and when the operated magnetic flux saturation constant is smaller than the magnetic flux saturation constant in the previous period, and when the operated magnetic flux saturation constant is smaller than the preset reference magnetic flux saturation constant, the stroke reference value generation unit 10 decreases the stroke reference value by a predetermined level (S44-6).

The comparison unit 20 outputs to the control unit 30 the difference signal between the stroke reference value generated in the stroke reference value generation unit 10 and the operated stroke estimated value of the reciprocating compressor (S45-1).

On the basis of the difference signal from the comparison unit 20, when the stroke estimated value is larger than the stroke reference value, the control unit 30 decreases the voltage applied to the motor of the reciprocating compressor (S45-2), and when the stroke estimated value is smaller than the stroke reference value, the control unit 30 increases the voltage applied to the motor of the reciprocating compressor (S45-3), thereby controlling the stroke of the reciprocating compressor.

As discussed earlier, in accordance with the present invention, the apparatus for controlling the operation of the reciprocating compressor and the method therefor reduce errors of the stroke estimated value of the reciprocating compressor, by previously preventing over-saturation of the magnetic flux density generated in the coil of the motor, by operating the magnetic flux saturation constant of the motor on the basis of the stroke estimated value of the reciprocating compressor and increasing or decreasing the stroke reference value on the basis of the operated magnetic flux saturation constant.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a reciprocating compressor, comprising:

a magnetic flux saturation constant operation unit for operating a magnetic flux saturation constant of a motor of the reciprocating compressor on the basis of a stroke estimated value of the reciprocating compressor;

a stroke reference value generation unit for generating an increased or decreased stroke reference value by increasing or decreasing a predetermined stroke reference value on the basis of the operated magnetic flux saturation constant; and a control unit for controlling a voltage applied to the motor of the reciprocating compressor on the basis of the generated stroke reference value.

2. The apparatus of claim 1, wherein the magnetic flux saturation constant is obtained by dividing a stroke absolute size in one period corresponding to one reciprocating stroke of the reciprocating compressor by a summation value of a stroke absolute value in the period.

3. The apparatus of claim 1, wherein the magnetic flux saturation constant is obtained by dividing a stroke absolute size in one period corresponding to one reciprocating stroke of the reciprocating compressor by a stroke root means square value in the period.

4. The apparatus of claim 1, wherein the stroke reference value generation unit generates the increased or decreased stroke reference value, by comparing the operated magnetic flux saturation constant with a preset reference magnetic flux saturation constant, and increasing or decreasing the stroke reference value according to the comparison result.

5. The apparatus of claim 4, wherein, when the operated magnetic flux saturation constant is larger than the magnetic flux saturation constant in the previous period, and when the operated magnetic flux saturation constant is larger than the preset reference magnetic flux saturation constant, the stroke reference value generation unit decreases the stroke reference value, and when the operated magnetic flux saturation constant is larger than the magnetic flux saturation constant in the previous period, and when the operated magnetic flux saturation constant is smaller than the preset reference magnetic flux saturation constant, the stroke reference value generation unit increases the stroke reference value.

6. The apparatus of claim 4, wherein, when the operated magnetic flux saturation constant is smaller than the magnetic flux saturation constant in the previous period, and when the operated magnetic flux saturation constant is larger than the preset reference magnetic flux saturation constant, the stroke reference value generation unit increases the stroke reference value, and when the operated magnetic flux saturation constant is smaller than the magnetic flux saturation constant in the previous period, and when the operated magnetic flux saturation constant is smaller than the preset reference magnetic flux saturation constant, the stroke reference value generation unit decreases the stroke reference value.

7. The apparatus of claim 5, wherein the preset reference magnetic flux saturation constant is the maximum value of the magnetic flux saturation constant for operating the motor of the reciprocating compressor when a magnetic flux density generated in a coil of the motor is saturated.

8. The apparatus of claim 6, wherein the preset reference magnetic flux saturation constant is the maximum value of the magnetic flux saturation constant for operating the motor of the reciprocating compressor when a magnetic flux density generated in a coil of the motor is saturated.

9. The apparatus of claim 1, wherein the control unit further comprises a comparison means for comparing the stroke estimated value with the generated stroke reference value.

10. The apparatus of claim 9, wherein, when the stroke estimated value is larger than the stroke reference value, the control unit decreases the voltage applied to the motor of the reciprocating compressor, and when the stroke estimated value is smaller than the stroke reference value, the control unit increases the voltage applied to the motor of the reciprocating compressor.

11. A method for controlling an operation of a reciprocating compressor, comprising the steps of:

operating a magnetic flux saturation constant of a motor of the reciprocating compressor on the basis of a stroke of the reciprocating compressor;

generating an increased or decreased stroke reference value by increasing or decreasing a predetermined stroke reference value on the basis of the operated magnetic flux saturation constant; and controlling a voltage applied to the motor of the reciprocating compressor on the basis of the generated stroke reference value and the operated stroke estimated value.

12. The method of claim 11, wherein the magnetic flux saturation constant is obtained by dividing a stroke absolute size in one period corresponding to one reciprocating stroke of the reciprocating compressor by a stroke summation value in the period.

13. The method of claim 11, wherein the magnetic flux saturation constant is obtained by dividing a stroke absolute size in one period corresponding to one reciprocating stroke of the reciprocating compressor by a stroke root means square value in the period.

14. The method of claim 11, wherein the step for generating the stroke reference value comprises a step for generating the increased or decreased stroke reference value by comparing the operated magnetic flux saturation constant with a preset reference magnetic flux saturation constant, and increasing or decreasing the predetermined stroke reference value according to the comparison result.

15. The method of claim 14, wherein the step for generating the stroke reference value comprises a step for decreasing the stroke reference value, when the operated magnetic flux saturation constant is larger than the magnetic flux saturation constant in the previous period, and when the operated magnetic flux saturation constant is larger than the preset reference magnetic flux saturation constant, and increasing the stroke reference value when the operated magnetic flux saturation constant is larger than the magnetic flux saturation constant in the previous period, and when the operated magnetic flux saturation constant is smaller than the preset reference magnetic flux saturation constant.

16. The method of claim 14, wherein the step for generating the stroke reference value comprises a step for increasing the stroke reference value, when the operated magnetic flux saturation constant is smaller than the magnetic flux saturation constant in the previous period, and when the operated magnetic flux saturation constant is larger than the preset reference magnetic flux saturation constant, and decreasing the stroke reference value when the operated magnetic flux saturation constant is smaller than the magnetic flux saturation constant in the previous period, and when the operated magnetic flux saturation constant is smaller than the preset reference magnetic flux saturation constant.

17. The method of claim 15, wherein the preset reference magnetic flux saturation constant is the maximum value of the magnetic flux saturation constant for operating the motor of the reciprocating compressor when a magnetic flux density generated in a coil of the motor is saturated.

18. The method of claim 16, wherein the preset reference magnetic flux saturation constant is the maximum value of the magnetic flux saturation constant for operating the motor of the reciprocating compressor when a magnetic flux density generated in a coil of the motor is saturated.

19. The method of claim 11, wherein the step for controlling the voltage further comprises a step for comparing the stroke estimated value with the stroke reference value.

20. The method of claim 19, wherein the step for controlling the voltage comprises a step for decreasing the voltage applied to the motor of the reciprocating compressor, when the stroke estimated value is larger than the stroke reference value, and increasing the voltage applied to the motor of the reciprocating compressor, when the stroke estimated value is smaller than the stroke reference value.

* * * * *